United States Patent [19]

Fried et al.

[11] 4,288,203

[45] Sep. 8, 1981

[54] MULTI-FLOW GAS DYNAMIC PRESSURE-WAVE MACHINE

[75] Inventors: Reinhard Fried, Nussbaumen; Günter Kudernatsch, Klingnau, both of Switzerland

[73] Assignee: BBC Brown, Boveri & Company Limited, Baden, Switzerland

[21] Appl. No.: 69,121

[22] Filed: Aug. 23, 1979

[30] Foreign Application Priority Data

Oct. 2, 1978 [CH] Switzerland ..... 10216/78

[51] Int. Cl.[3] ..... F04F 11/02

[52] U.S. Cl. ..... 417/64

[58] Field of Search ..... 417/64; 60/39.45 A

[56] References Cited

U.S. PATENT DOCUMENTS

| | | | |
|---|---|---|---|
| 2,705,867 | 4/1955 | Lewis | 417/64 |
| 2,764,340 | 9/1956 | Jendrassik | 417/64 |
| 3,109,580 | 11/1963 | Kentfield | 417/64 |
| 3,120,920 | 2/1964 | Waleffe et al. | 417/64 |
| 3,556,680 | 1/1971 | Leutwyler et al. | 417/64 |
| 3,776,663 | 12/1973 | Croes | 417/64 |
| 3,998,567 | 12/1976 | Fried | 417/64 X |

*Primary Examiner*—Carlton R. Croyle
*Assistant Examiner*—Edward Look
*Attorney, Agent, or Firm*—Burns, Doane, Swecker & Mathis

[57] ABSTRACT

A multi-flow gas-dynamic pressure-wave machine, the rotor of which comprises at least one intermediate tube which subdivides the cell zone into at least two flow channels. The cell walls of adjacent flow channels are circumferentially staggered by essentially one-half the circumferential interface between such cells to produce a reduction in noise due to the beat interference produced by the sound pressures occurring in the cells adjacent to one another in the radial direction. The rotor may be provided with a concertina-shaped or undulation-shaped intermediate tube whereby there occurs a more balanced distribution of stresses, requiring less accelerating power.

11 Claims, 9 Drawing Figures

FIG.1
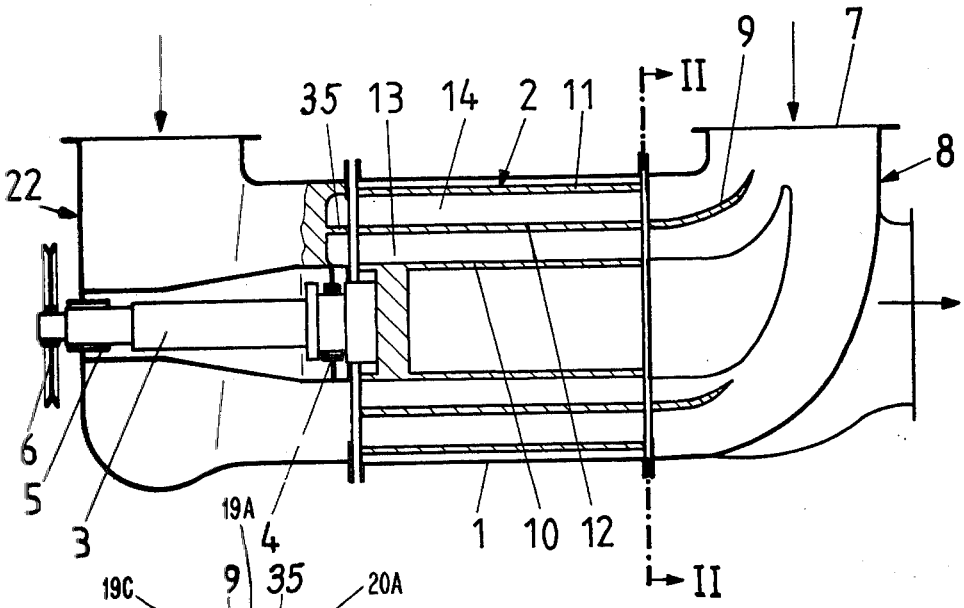
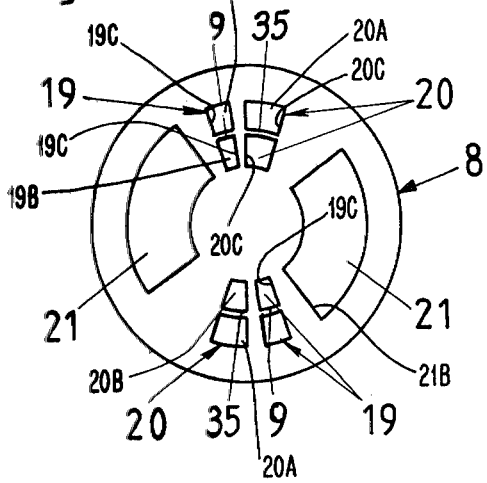
FIG. 2

MULTI-FLOW GAS DYNAMIC PRESSURE-WAVE MACHINE

BACKGROUND AND OBJECTS OF THE INVENTION

The present invention relates to a multi-flow gas-dynamic pressure-wave machine.

The single-flow pressure-wave machines in predominant use today are a source of noise nuisance. It is desirable to reduce such noise in response to the continuously hardening demands of environmentalists, and also in the justified interest of the public. A pressure-wave machine is disclosed, for example, in U.S. Application Ser. No. 932,954 of Nicolaus Croes et al, filed Aug. 11, 1978, now Pat. No. 4,232,999 the disclosure of which is incorporated herein by reference.

Various solutions have already been proposed to reduce the noise levels of such devices. In one of these proposals, viz., Swiss Pat. No. 398,184, it is suggested to subdivide the height of the rotor cells (i.e., the cells in which the pressure exchange between the gaseous working media takes place) in the radial direction by annular-cylindrical intermediate tubes to form several circular flows. It is intended thereby to position the fundamental frequency of the sound vibrations above the upper threshold of hearing of the human ear. The intended effect is not, however, achieved in this way since it only causes several oscillations of the same frequency to be superimposed upon one another and the fundamental frequency is retained.

The construction described in that patent also has disadvantages with respect to production. Due to the annular cross-section of the intermediate tubes and the uniformly thick cell walls, heat and centrifugal tensions are created which cause deformations and overloading of the rotor structure.

It is, therefore, an object of the invention to avoid these disadvantages.

Another object of the invention is to reduce the noise level produced by pressure wave machines.

SUMMARY OF THE INVENTION

These objects are achieved by a multi-flow gas-dynamic pressure-wave machine of the type comprising a rotor. The rotor includes a hub tube and a shroud located radially outwardly thereof to form a cell zone therewith for receiving a gaseous working media. The cell zone is subdivided into at least two concentric flow channels by means of intermediate tube means arranged between the hub tube and the shroud. Cell walls are disposed in each channel. A housing encloses the rotor. An air housing and a gas housing are provided. The latter includes ducts for the supply and removal of the gaseous working media relative to the rotor. The cell walls of one flow channel and the cell walls of an adjacent flow channel are circumferentially staggered with respect to one another by essentially one-half the circumferential interface between such cells.

THE DRAWING

In the following text the invention is described in greater detail with the aid of the drawing, in which:

FIG. 1 is a longitudinal section of a dual-flow pressure-wave machine according to the invention, FIG. 2 is a cross-sectional view of the machine taken along line II—II in FIG. 1, to show the exhaust and air ducts in a side part of the housing, FIG. 3 is a cross-sectional view through the rotor of the machine according to FIG. 1, FIG. 4 shows the design of the control edges of the air and gas housing in a preferred embodiment, FIG. 5 shows a further preferred embodiment of the control ducts, FIG. 6 shows a preferred embodiment of the cell walls and of the intermediate tube of the rotor, FIG. 7 shows a further advantageous embodiment of the intermediate tube of the rotor, FIG. 8 shows an embodiment of the rotor with unequal cell divisions, and FIG. 9 shows a triple-flow rotor.

DETAILED DESCRIPTION OF PREFERRED EMBODIMENTS OF THE INVENTION

Figure 3:
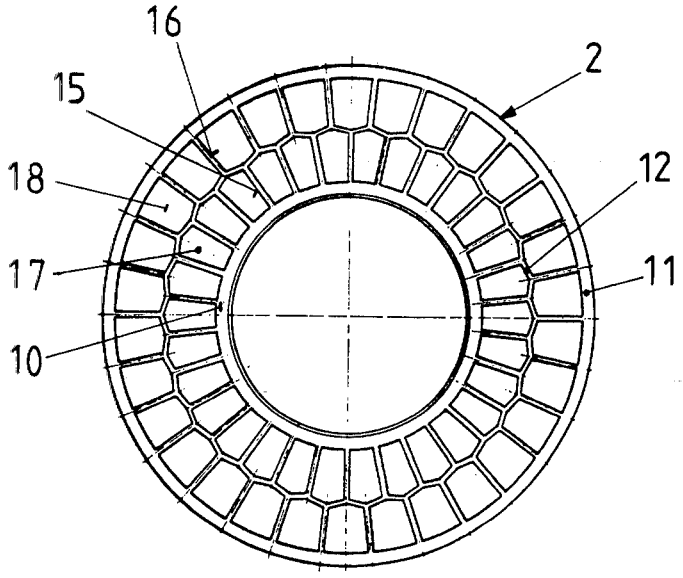

In FIG. 1, numeral 1 designates a housing shell surrounding a rotor 2. This rotor is rigidly joined to a shaft 3 which is supported for rotation in two bearings 4 and 5 and can be driven by a V-belt pulley 6.

Gases coming, for example, from an internal combustion engine enter the gas housing 8 at the connecting inlet 7 where the gas flow is split into two partial flows by a partition 9.

The rotor 2 comprises a hub tube 10, a shroud 11 and an intermediate tube 12. The area between the hub tube 10 and the shroud 11 constitutes a cell zone which is subdivided into separate flow channels by the intermediate tube 12. The hub tube 10 and intermediate tube 12 form the boundaries of an inner flow channel 13. The hub tube 10 and the shroud 11 form the boundaries of an outer flow channel 14. It can be seen from the side elevation of the rotor, shown in FIG. 3, that the hub tube 10 and the shroud 11 are of annular-cylindrical construction, while the intermediate tube 12 has a concertina-shaped cross-section. The two flow channels 13 and 14, which are concentric, are subdivided in the direction of the circumferential periphery by inner and outer radial cell walls 15 and 16, respectively, into a number of inner and outer cells 17, 18. The cells 17 are identical, and the cells 18 are identical. In accordance with the present invention the inner and outer cells are circumferentially staggered by a distance amounting to essentially one-half of the circumferential interface between the inner and outer cells, i.e., by one-half of a cell width.

By subdividing the cells into two flow channels 13, 14, the number of noise-generating pressure pulses is doubled. By displacing or staggering the cells of one flow channel by one-half a cell width with respect to the cells of the other channel, as can be seen from FIG. 3, there is produced a displacement in time of the pressure pulses of one channel with respect to the other channel by exactly half a period. The bear interference arising from such an out-of-phase relationship reduces the amplitude of the fundamental frequency. Thus, a beat interference arises which has an amplitude-reducing effect on the fundamental frequency.

The effectiveness of this expedient is strongly dependent upon the noise spectrum generated by this rotor. In machines which have been heretofore constructed, the intensity of the fundamental frequency contributes most strongly to the noise nuisance, when measured subjectively or objectively. The contribution of harmonics in the generation of noise is relatively low; the second harmonic is already quieter by 20 dB than the noise caused by the fundamental. But it is not possible, indeed, to totally eliminate the fundamental. Theoretically, this would be possible only with infinitely small cell heights, because the pressure variations can affect each other only in the immediate environment of the intermediate tube. Gas particles which are far apart in the radial direction are not affected by the effects of the beat interference because they cannot pulsate against each other due to their distance apart.

Since the fundamental frequency and also its harmonics are present, and since the displacement of the cell walls reduces only the amplitudes of the fundamental and its odd multiples, only the even multiples of the fundamental frequency dominate the remaining noise spectrum.

The circular area occupied by all cells, including the cell walls, can be distributed to the two flow channels preferably with identical heights (i.e., radial dimension) or identical areas. The distribution by equal heights is more advantageous thermodynamically while a distribution by equal areas produces a greater reduction in noise. If it is more important, therefore, to reduce the noise level the distribution will be by equal areas whereby the cross-sectional area of flow channel 13 equals that of flow channel 14.

The radially inner ends of the cell walls 16 of the outer flow channel 14 intersect the concertina-shaped intermediate tube 12 at the highest points, i.e., radially outermost points, thereof in each case. The radially outer ends of the inner cell walls 15, intersect the lowest, i.e., radially innermost, points of the intermediate tube 12. Thus, the cell walls extend between the hub tube 10 and the shroud 11, respectively, and the crests of the concertina-shaped intermediate tube 12 which are facing them in each case.

FIG. 2 shows a front view of the flange side of the gas housing 8 according to the section line II—II indicated in FIG. 1. In this FIG. 2, numeral 19 designates inlet ducts for the high-pressure exhaust gas; numeral 20 designates gas pockets which enlarge the operating range of the pressure-wave machine in a known manner (e.g., see above-mentioned U.S. application Ser. No. 932,954); and numeral 21 designates a low pressure outlet duct for the expended exhaust gas. Corresponding inlet and outlet ducts for the air sucked-in and compressed, as well as gas pockets are also provided at the flange side of the air housing 22 (see FIG. 1).

The inlet ducts 19 for the high-pressure gas, and also the gas pockets 20, are each interrupted in the radial direction by partitions. In this regard, partitions 9 divide the inlet duct 19 into sections 19A, 19B and partitions 35 divide the pockets 20 into sections 20A, 20B. This causes the gaseous working media to be divided and guided before entering the two flow channels 13, 14 of the rotor 2. FIG. 2 shows that the control edges, or boundary edges 19C, of the ducts 19 and the boundary edges 21A of the ducts 21, formerly edges 20C, of the pocket 20 (which edges 19C, 21A, 20C run transversely of the direction of the rotor periphery), are straight and extend radially. If the cell walls 15, 16 of the rotor 2 are also constructed to be radial and straight, as is the case with the rotor construction shown in FIG. 3, the cell ducts of the inner and outer flow channels of the rotor open rather abruptly with respect to the stationary ducts in the air and gas housing. Thus, the free duct cross-section increases rapidly. The shock-like inflow of gas or air caused by this sudden increase in cross-section leads to subjectively more unpleasant noises since, due to the resulting pressure profile, component of higher frequency are created which it would be desirable to eliminate or at least reduce.

Figure 4:
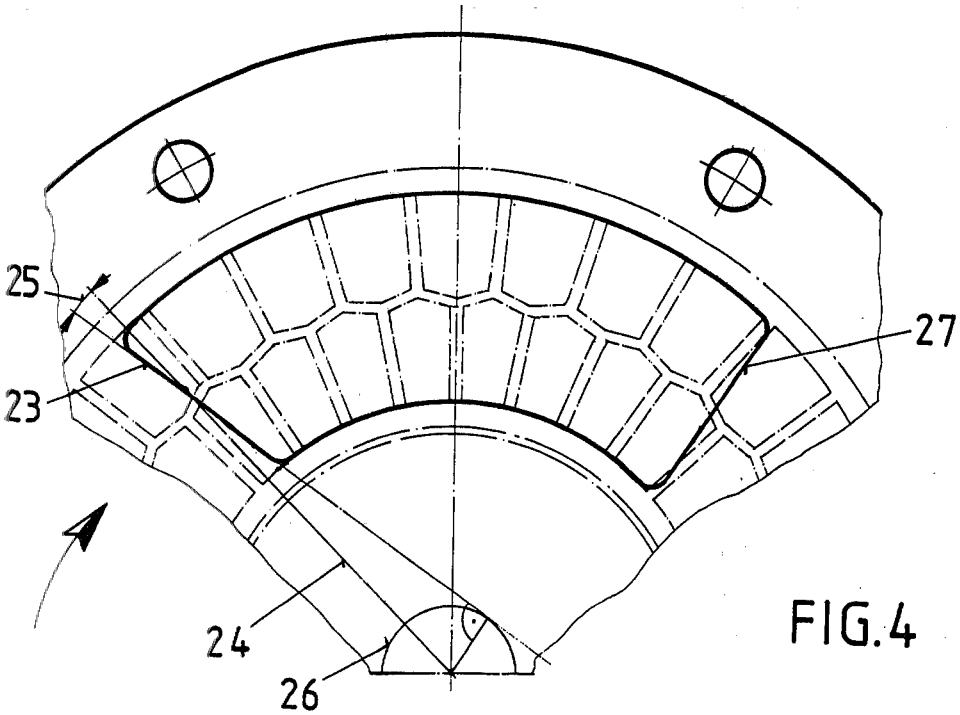
Figure 5:
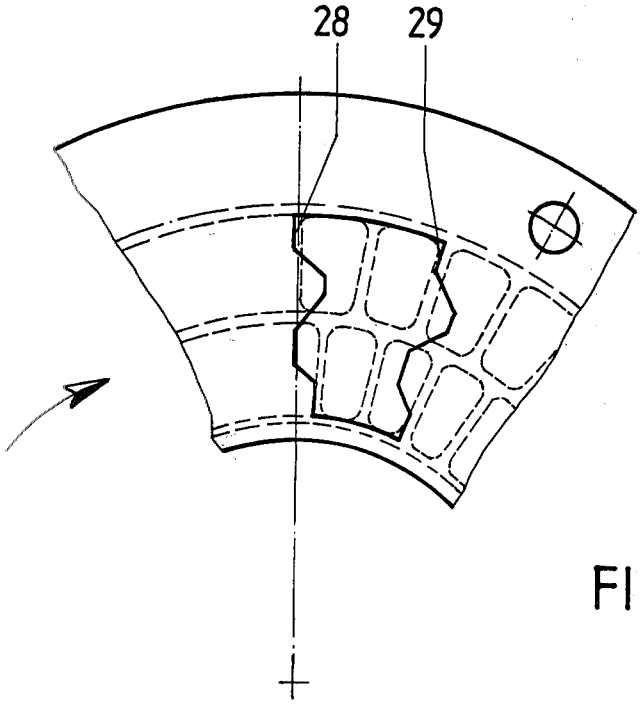

It has been discovered and verified by tests that the noise component originating from this source can be reduced by constructing the afore-mentioned boundary edges 19C, 21A (i.e., the edges disposed transversely to the direction of the rotor periphery) of the inlet and outlet ducts 19, 21 for gas (or air), not radially, but rather in the form of a secant (FIG. 4) or in the form of an undulating line running essentially in the radial direction (FIG. 5).

The control edge 23 according to the embodiment of FIG. 4 of a low-pressure gas duct (or low-pressure air duct) is a straight line which, with reference to the circle defined by the shroud 11, assumes the position of a secant which, together with the radial line 24, forms an angle 25. The edge 23 can also be considered to be a tangent relative to an imaginary circle 26, the center of which is defined by the axis of the rotor. The control edge 23 could also be inclined in the other direction with respect to the radial line 24, of course, i.e., the radially inner end of the edge 23 disposed on the opposite side of the rotor axis.

With this inclined arrangement of the control edges 23, a shock-like gas (or air) entry is avoided because the flow cross-section is released with only a gradual increase and the noise development associated therewith is reduced.

The second, rear control edge 27 ("rear" in the sense of rotor rotation indicated by arrows) is also constructed to be inclined with respect to the radial line at the point concerned, so that the inflow of gas (or air) into the rotor cells is throttled not in a shock-like manner but, as mentioned above, gradually, which also contributes to the reduction in noise.

FIG. 5 shows another form of the control edges, also for the purpose of causing a reduction in noise by gradually opening or closing the flow cross-section. This form is applied to a high-pressure air duct. These control edges 28, 29 have an undulating shape in a generally radial direction. As compared to the control edge 23 according to FIG. 4, the opening edge 28 of FIG. 5 produces a greater increase in the opening cross-section in the initial phase of the opening process.

In addition, the undulating shape of the control edges 28, 29 has the same acoustic effect as the displacement circumferential staggering of the cells with respect to one another, described previously. This is because each cell is charged in two stages, displaced in time with respect to one another by half the division, with the noise-reducing beat interference effect as described above.

The intermediate tube of the rotor shown partially in FIG. 5 is of annular-cylindrical construction, in deviation from the concertina-shaped intermediate tube of the other rotors described here. It does not, therefore, have the advantages with respect to rigidity and operation, described in the following paragraphs, of rotors with concertina-shaped and undulating intermediate tubes, but it is equivalent thereto from an acoustic standpoint.

Figure 6:
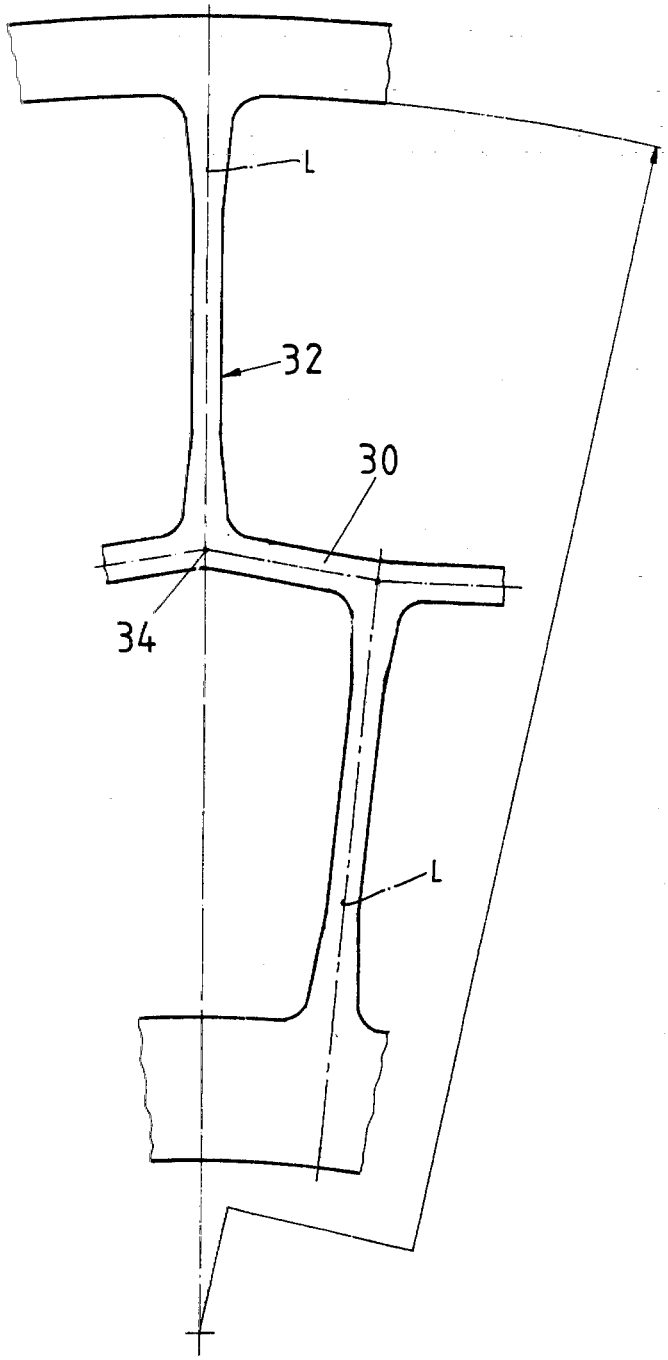
Figure 7:
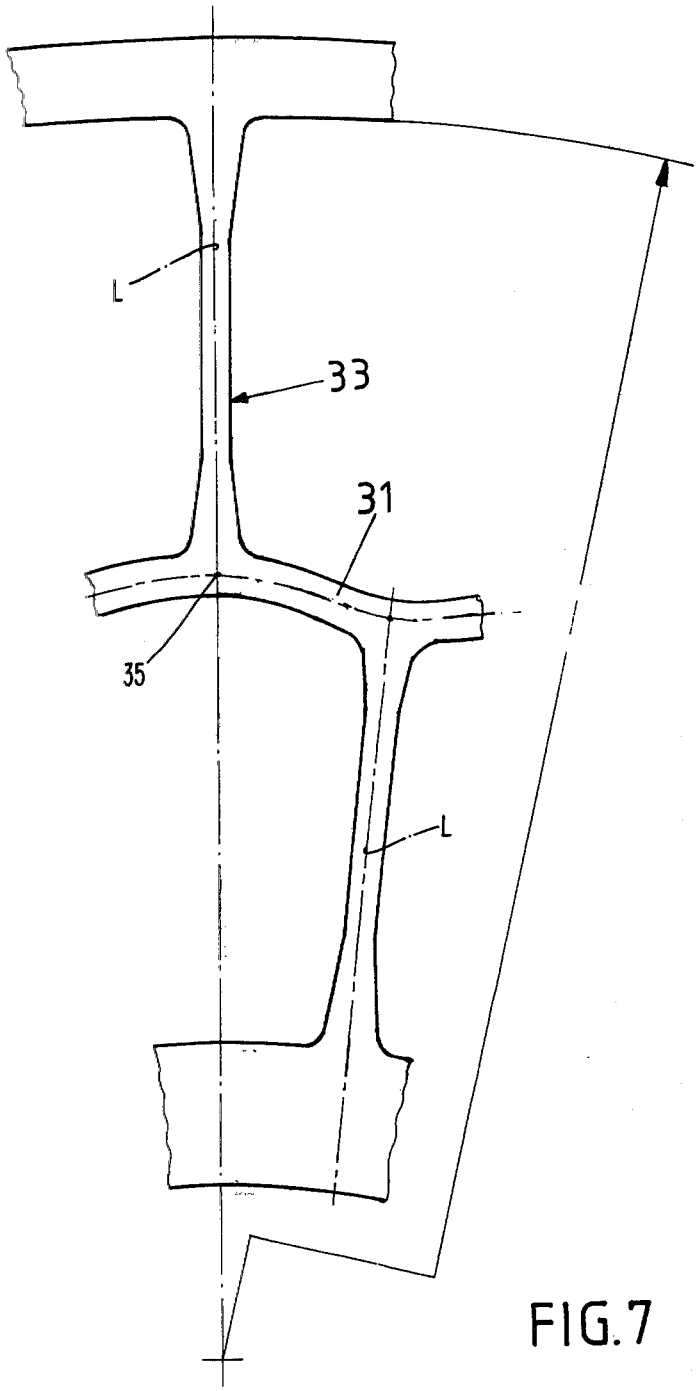

The concertina-shaped construction of the intermediate tube 12, described in connection with FIG. 3, has advantages with respect to rigidity as compared with a customary annular cylindrical intermediate tube. Under operating load, high bending stresses occur in such tubes and in certain areas the peak tensile stress reaches the yield point of the rotor material which is relatively low due to the high operating temperatures involved. The concertina-shaped construction of the intermediate tube 30 according to FIG. 6 and of the undulation-shaped intermediate tube 31 according to FIG. 7, makes it possible to attain freedom from stress moments in the immediate vicinity of the junction 34 of the center lines L of the cell walls 32 and 33 (or the junction 35 of the cell walls 31, 33) into the respective intermediate tube at maximum operating loads. Also, by virtue of this expedient, the displacement of the point of the intersection 34 of the center lines of intermediate tube 30 and cell wall 32 due to these operating loads becomes less, and thus also the expansion of the shroud. Thus the load on the latter is reduced but, instead, the hub tube is utilized more extensively as a support. This produces a more uniform distribution of stresses, and thus a better utilization of the materials which, in turn, makes it possible to have thinner walls. Further advantages produced by this expedient are a reduced mass moment of inertia, a considerable reduction in required acceleration power and lighter, and thus cheaper, drive elements for the rotor.

Since the free length of the cell walls is reduced in the distribution to several flow channels, the mutual loading by the difference in gas pressure between two adjacent cells, too, is much less. For this reason, the walls can be made thinner. The walls do, however, increase in thickness at the junction with the shroud, the intermediate tube and the hub tube, thereby greatly reducing the loads due to the restraining moments at these places.

Figure 8:
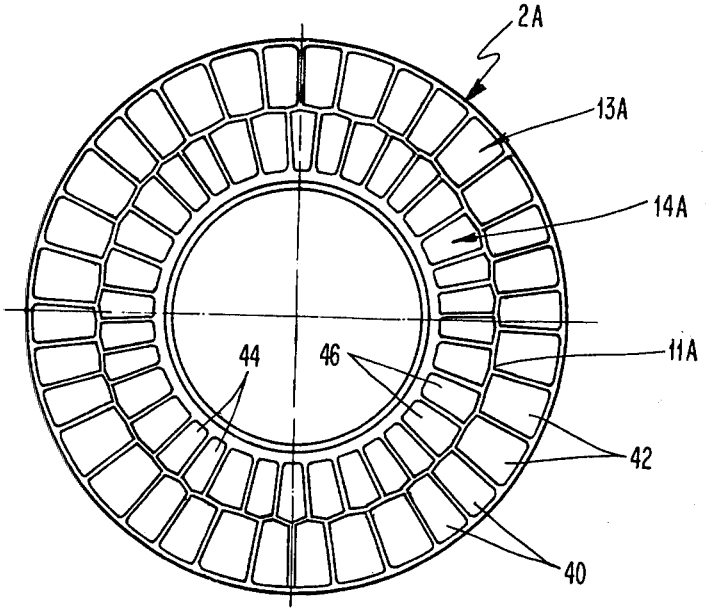

In an embodiment of the rotor 2A shown in FIG. 8, the two flow channels are also separated by a concertina-shaped intermediate tube 11A. The cells of each flow channel are constructed with different widths in a known manner (see Swiss Pat. No. 470,588) in order to achieve a more uniform and thus physiologically more tolerable noise spectrum. In this arrangement, a number of narrower cells 40 (or 44) alternate with a number of wider cells 42 (or 46) in accordance with a precalculable pattern. The cell walls of one flow channel 13A are circumferentially staggered with respect to those of the other flow channel 14A by at least half the respective circumferential interface, in order to achieve a reduction in noise by beat interference, as described above.

Figure 9:
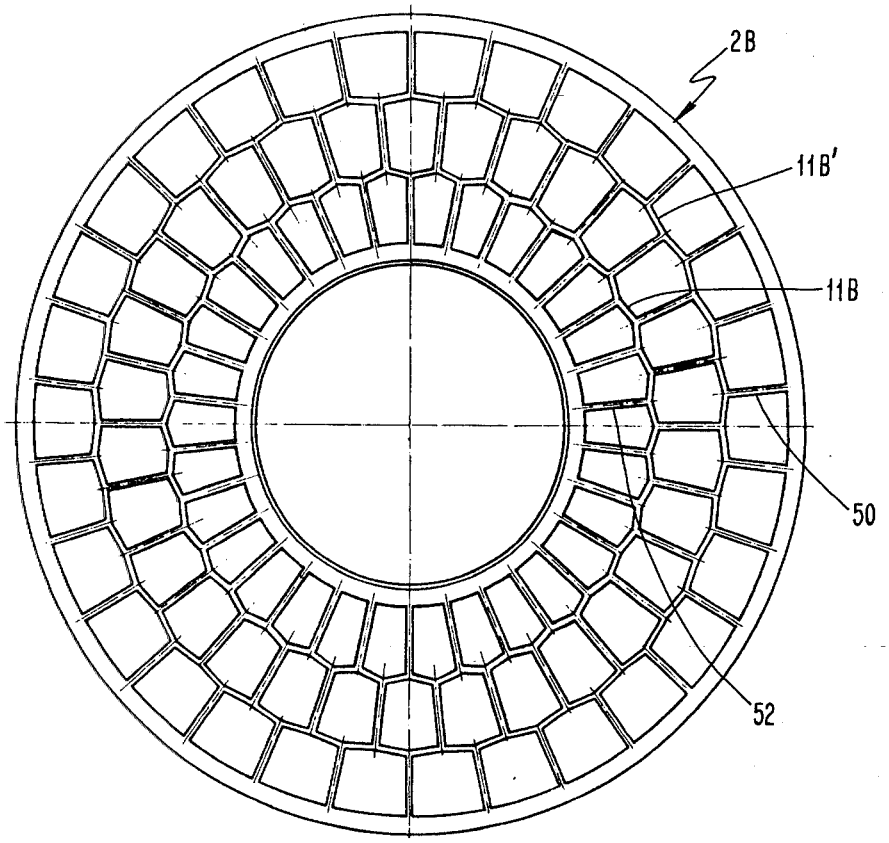

The rotor 2B according to an embodiment depicted in FIG. 9 is of triple-flow construction with intermediate tubes 11B, 11B' of concertina-shaped cross-section. The cell walls of each one flow channel are circumferentially staggered with respect to those of each adjacent flow channel by at least approximately half the length of the circumferential interface, so that the cell walls 50, 52 of the outermost and of the innermost flow channel, ending at the hub tube are essentially aligned with each other, that is, lie on a common radial line.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. In a multi-flow gas-dynamic pressure-wave machine of the type comprising a rotor, the rotor including a hub tube and a shroud located radially outwardly thereof to form a cell zone therewith for receiving a gaseous working media, the cell zone being subdivided into at least two concentric flow channels by means of at least one intermediate tube arranged between the hub tube and the shroud, cell walls disposed in each flow channel, a housing enclosing the rotor, an air housing, a gas housing, and ducts for the supply and removal of the gaseous working media relative to the rotor, the improvement wherein the cell walls of one flow channel and the cell walls of an adjacent flow channel are circumferentially staggered with respect to one another by essentially one-half the circumferential interface between such cells, and a point of intersection of the center line of an outer cell wall with the center line of the intermediate tube is farther away radially from the axis of the rotor than the point of intersection of the center line of an adjacent inner cell wall with the center line of the intermediate tube.

2. Pressure-wave machine according to claim 1, wherein the intermediate tube has a concertina-shaped cross-section.

3. Pressure-wave machine according to claim 1, wherein the intermediate tube has an undulating cross-section.

4. Pressure-wave machine according to claim 1, wherein the cells are of different sizes.

5. Pressure-wave machine according to claim 1, wherein inside the gas housing partitions are provided in the supply ducts to the rotor for distributing the gas flow to the two flow channels of the rotor.

6. Pressure-wave machine according to claim 1, wherein the cross-sectional areas of the flow channels are substantially equal.

7. Pressure-wave machine according to claim 6, wherein said gas housing includes pockets facing said flow channels each pocket being subdivided by a web which corresponds to the subdivision of the cell zone.

8. Pressure-wave machine according to claim 1, wherein the radial heights of the flow channels are substantially equal.

9. Pressure-wave machine according to claim 1, wherein the cell walls of the rotor are provided with a cross-section which becomes wider at the intersection thereof with the shroud, hub tube, and intermediate tube.

10. In a multi-flow gas-dynamic pressure-wave machine of the type comprising a rotor, the rotor including a hub tube and a shroud located radially outwardly thereof to form a cell zone therewith for receiving a gaseous working media, the cell zone being subdivided into at least two concentric flow channels by means of at least one intermediate tube arranged between the hub tube and the shroud, cell walls disposed in each flow channel, a housing enclosing the rotor, an air housing, a gas housing, and ducts for the supply and removal of the gaseous working media relative to the rotor, the improvement wherein the cell walls of one flow channel and the cell walls of an adjacent flow channel are circumferentially staggered with respect to one another by essentially one-half the circumferential interface between such cells, said gas housing includes gas inlet and outlet openings, said air housing includes air inlet and outlet openings, each opening including a control edge extending transversely of the circumference, at least one of said control edges being located on a tangent which touches an imaginary auxiliary circle which is concentric to the rotor.

11. In a multi-flow gas-dynamic pressure-wave machine of the type comprising a rotor, the rotor including a hub tube and a shroud located radially outwardly thereof to form a cell zone therewith for receiving a gaseous working media, the cell zone being subdivided into at least two concentric flow channels by means of at least one intermediate tube arranged between the hub tube and the shroud, cell walls disposed in each flow channel, a housing enclosing the rotor, an air housing, a gas housing, and ducts for the supply and removal of the gaseous working media relative to the rotor, the improvement wherein the cell walls of one flow channel and the cell walls of an adjacent flow channel are circumferentially staggered with respect to one another by essentially one-half the circumferential interface between such cells, said gas housing includes gas inlet and outlet openings, said air housing includes air inlet and outlet openings, each opening including a control edge extending transversely of the circumference, at least one of said control edges being S-shaped in the vicinity of each of the flow channels.

* * * * *